US005104294A

United States Patent [19]

Banba

[11] Patent Number: 5,104,294

[45] Date of Patent: Apr. 14, 1992

[54] HYDRAULIC PUMP ASSEMBLY WITH ACCUMULATOR AND OIL RESERVOIR

[75] Inventor: Kunio Banba, Saitama, Japan

[73] Assignee: Kabushiki Kaisha Showa Seisakusho, Tokyo, Japan

[21] Appl. No.: 714,518

[22] Filed: Jun. 13, 1991

[30] Foreign Application Priority Data

Jun. 14, 1990 [JP] Japan ..... 2-62902

[51] Int. Cl.[5] ..... F04B 49/02

[52] U.S. Cl. ..... 417/36; 417/540; 60/418

[58] Field of Search ..... 417/36, 40, 540; 60/418, 415, 413

[56] References Cited

U.S. PATENT DOCUMENTS 4,738,595 4/1988 Gaiser ..... 417/36

4,924,670 5/1990 Bausey ..... 417/540

*Primary Examiner*—Leonard E. Smith

*Attorney, Agent, or Firm*—Rosen, Dainow & Jacobs

[57] ABSTRACT

A hydraulic pump composed of a pump and an accumulator combined therewith has an outer shell divided into an accumulator cylinder of metal and a tank of resin. The accumulator cylinder and said tank have thicker side portions, respectively, which define therein an outlet oil passage and an inlet oil passage, respectively.

7 Claims, 2 Drawing Sheets

HYDRAULIC PUMP ASSEMBLY WITH ACCUMULATOR AND OIL RESERVOIR

BACKGROUND OF THE INVENTION

1. Field of the Invention

The present invention relates to a hydraulic pump assembly, and more particularly to a hydraulic pump assembly comprising a hydraulic pump coupled to an oil accumulator, for supplying working oil to an actuator in a power steering device for an outboard engine.

2. Description of the Relevant Art

FIG. 3 of the accompanying drawings shows a hydraulic pump assembly 100 for supplying, when required, working oil to an actuator in a power steering device for an outboard engine. The hydraulic pump assembly 100 normally stores therein working oil under pressure so that it can be supplied from the hydraulic pump assembly 100. When required, the stored working oil is supplied to the actuator (not shown) in the power steering device. After the required working oil has been supplied or while it is being supplied, the hydraulic pump assembly 100 is replenished with the same amount of additional working oil.

More specifically, the hydraulic pump assembly 100 comprises a pump 104 drivable by an electric motor 110, and an accumulator 102. Usually, working oil is stored under high pressure in the accumulator 102. The accumulator 102, and the motor 110 and the pump 104 are housed in upper and lower spaces, respectively, in an outer shell 101. The outer shell 101 defines therein a lower oil chamber 103 which serves as an oil reservoir for storing working oil.

The accumulator 102 comprises an accumulator cylinder 105 fixedly mounted in the shell 101, a piston 106 vertically slidably fitted in the accumulator cylinder 105, and a partition 107 fixedly disposed in the cylinder 105 below the piston 106. An upper inner wall surface of the cylinder 105 and the piston 106 jointly define therebetween a gas chamber G filled with a gas under high pressure. The lower surface of the piston 106 and the upper surface of the partition 107 jointly define an oil chamber 108 therebetween. In FIG. 3, almost all working oil is supplied from the pump assembly 100 to the actuator, with the oil chamber 108 being of a substantially minimum volume.

Between the electric motor 110 and the accumulator 102, there is interposed a cap 109 which has a gear 111 for supplying working oil and an inlet pipe 112 through which the gear 111 and the lower oil chamber 103 communicate with each other. The inlet pipe 112 has a lower end disposed in the oil chamber 103. The pump 104 is composed of the cap 109 and the gear 111. When the gear 111 is driven by the motor 110, the working oil in the lower oil chamber 103 is drawn through the inlet pipe 112 by the pump 104, and forcibly supplied into the oil chamber 108 through an oil passage (not shown) defined in the cap 109.

In the shell 101, the cap 109 is surrounded by a pipe attachment 114 mounted thereon and connected to an end of an outlet pipe 113 whose discharge port 116 is connected to the actuator. An on/off valve (not shown) controlled by the power steering device is joined between the discharge port 116 and the actuator. The oil chamber 108 communicates with the on/off valve through an oil passage 109*a* defined in the cap 109, the pipe attachment 114, and the discharge port 116.

A controller 115 is fitted in an upper recess of the accumulator cylinder 105. The controller 115 has upper and lower sensors 115*a*, 115*b* for detecting the position of an annular magnet 106*a* fixedly mounted in an upper portion of an inner hole defined in the piston 106.

When the piston 106 is in its lower limit position as detected by the lower sensor 115*b*, the controller 115 starts to energize the electric motor 110 to forcibly supply the working oil from the lower oil chamber 103 into the oil chamber 108 of the accumulator 102. When the piston 106 reaches its upper limit position as detected by the upper sensor 115*a* in response to the supplied working oil, the controller 115 de-energizes the electric motor 110.

The above operation of the controller 115 is independent of operation of the on/off valve positioned downstream of the discharge port 116. Therefore, the hydraulic pump assembly 100 normally stores working oil under high pressure in the oil chamber 108, and automatically discharges the stored working oil when the on/off valve downstream of the discharge port 116 opens.

The hydraulic pump assembly 100 is of a doublewalled structure composed of the cylinder 105 of the accumulator 102 and the outer shell 101 serving as an oil tank. Accordingly, it is necessary to install the inlet pipe 112, the attachment 114, and the outlet pipe 113 within the shell 101, resulting in an increased number of components used. The double-walled structure makes the outer profile of the shell 101 larger compared with the necessary outer profile of the accumulator cylinder 105. As a consequence, the power steering device for an outboard engine is complex in structure, and large in dimensions.

The present invention has been made in view of the aforesaid problems of the conventional hydraulic pump assembly for use in a power steering device for an outboard engine.

SUMMARY OF THE INVENTION

It is an object of the present invention to provide a hydraulic pump assembly for use in a power steering device for an outboard engine, the hydraulic pump assembly being made up of a reduced number of components and having reduced dimensions.

In order to accomplish the above object, there is provided in accordance with the present invention a hydraulic pump assembly having a pump and an accumulator combined therewith, characterized in that an outer shell of the hydraulic pump assembly is divided into an accumulator cylinder of metal and a tank of resin, and the accumulator cylinder and the tank have thicker side portions, respectively, which define therein an outlet oil passage and an inlet oil passage, respectively.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

Figure 1:
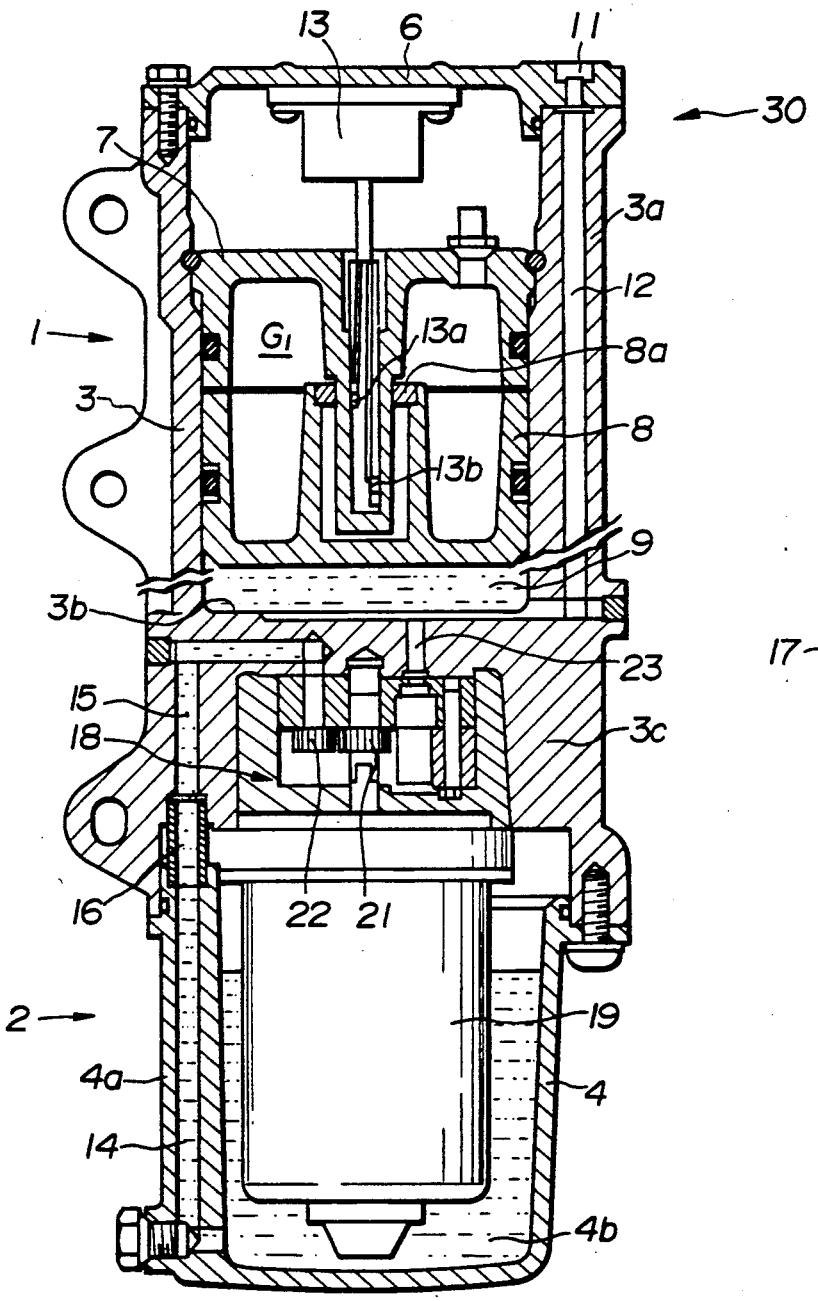
FIG. 1 is a vertical cross-sectional view of a hydraulic pump assembly according to a preferred embodiment of the present invention.

As shown in FIG. 1, a hydraulic pump assembly, generally designated by the reference numeral 30, according to the present invention serves to normally store therein working oil under high pressure so that it can be supplied from the hydraulic pump assembly 30, and also to supply the stored working oil to an actuator (not shown) in a power steering device for an outboard engine, when required.

The hydraulic pump assembly 30 comprises an accumulator 1 having an aluminum cylinder 3, and a tank unit 2 having a resin tank 4 attached to the lower end of the cylinder 3. The accumulator 1 is shown as storing a maximum amount of working oil in FIG. 1.

A cap 6 is fixed to the upper end of the cylinder 3. A partition 7 is fixedly fitted in the inner bore of the cylinder 3. In the inner bore of the cylinder 3, there is vertically slidably disposed a piston 8 between a dead end 3*b* of the inner bore and the partition 7. The upper surface of the piston 8 and the lower surface of the partition 7 jointly define therebetween a gas chamber G1 filled with a gas under high pressure. An oil chamber 9 is defined between the lower surface of the piston 8 and the inner bottom surface of the dead end 3*b* of the cylinder 3.

The cap 6 has a discharge port 11 which communicates with the actuator in the power steering device through an on/off valve (not shown). The cylinder 3 includes a thicker side wall 3*a* defining therein an outlet oil passage 12 held in communication with the discharge port 11. A controller 13 is attached to the lower or inner surface of the cap 6. An annular magnet 8*a* is attached to the upper end of an inner hole of the piston 8. The controller 13 has upper and lower sensors 13*a*, 13*b* disposed in a central hole defined in the partition 7, for detecting the position of the annular magnet 8*a* thereby to detect upper and lower limit positions for the piston 8. A pump 18 is disposed in a lower bottom wall 3*c* of the cylinder 3, and an electric motor 19 is mounted on the lower end of the pump 18.

The electric motor 19 is housed in the resin tank 4, which defines an oil chamber 4*b* as an oil reservoir, with oil stored therein. The tank 4 has a thicker side wall 4*a* in which there is defined an inlet oil passage 14 communicating with the oil chamber 4*a*. The oil passage 14 is also held in communication with an oil passage 15 through a joint pipe 16 interposed between the cylinder 3 and the tank 4, the oil passage 15 communicating with the pump 18 in the bottom end of the cylinder 3.

Figure 2:
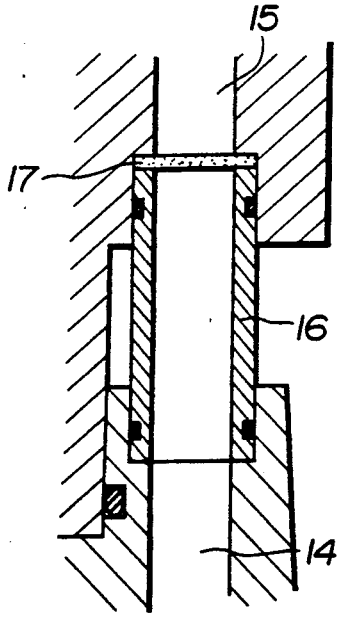
FIG. 2 is an enlarged fragmentary cross-sectional view of a joint pipe in the hydraulic pump assembly shown in FIG. 1.
Figure 3:
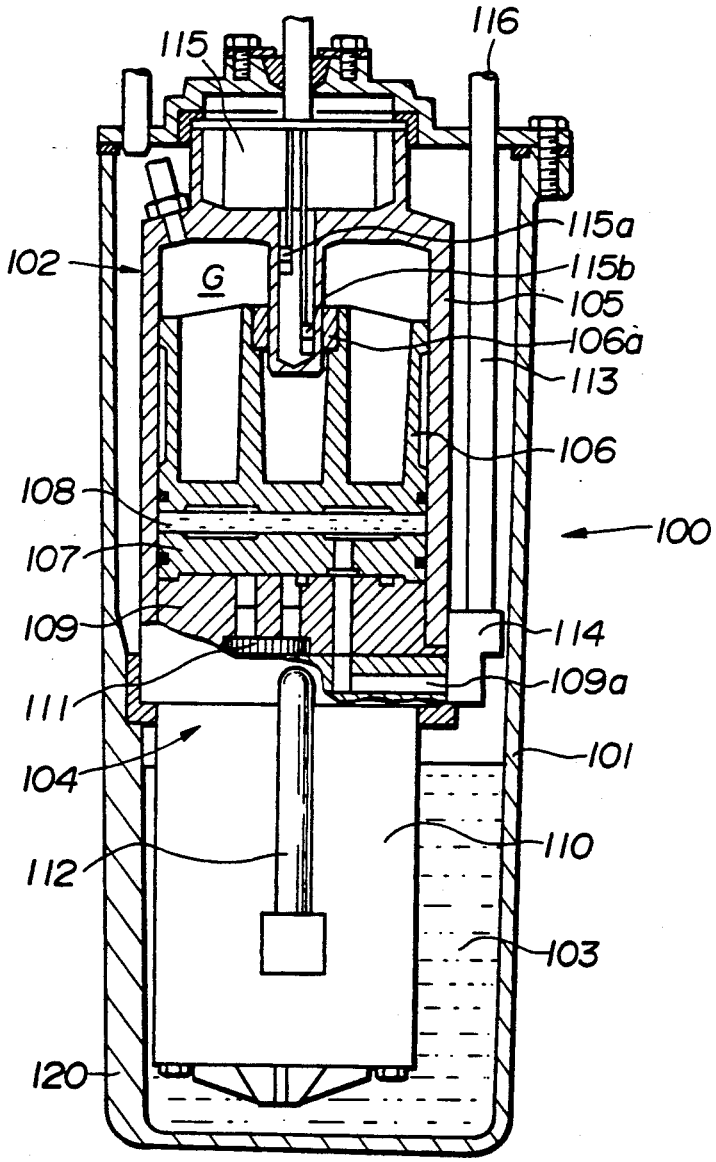
FIG. 3 is a vertical cross-sectional view of a conventional hydraulic pump assembly.

As shown in FIG. 2, a filter 17 is mounted on an end opening of the joint pipe 16 which is positioned in the cylinder 3. The joint pipe 16 is effective in reliably preventing air from being trapped into working oil flowing through the oil passages 14, 15 due to deformations of the cylinder 3 and the tank 4 which are induced by the difference between the materials thereof.

The pump 18 in the bottom end of the cylinder 3 has gears 21, 22 drivable by the electric motor 19 for drawing working oil from the lower oil chamber 4*a* through the oil passages 14, 15, and forcibly supplying the drawn oil into the oil chamber 9 through an oil passage 23 defined in the bottom end of the cylinder 3.

When the piston 8 is in its lower limit position as detected by the lower sensor 13*b*, the controller 13 starts to energize the electric motor 19 to forcibly supply the working oil from the lower oil chamber 4*a* into the oil chamber 9 of the accumulator 1. When the piston 8 reaches its upper limit position as detected by the upper sensor 13*a* in response to the supplied working oil, the controller 13 de-energizes the electric motor 19.

The above operation of the controller 13 is independent of operation of the on/off valve positioned downstream of the discharge port 11. Therefore, the hydraulic pump assembly 30 normally stores working oil under high pressure in the oil chamber 9, and automatically discharges the stored working oil when the on/off valve downstream of the discharge port 11 opens.

The hydraulic pump assembly 30 has an outer shell divided axially into two parts, i.e., composed of the metal accumulator cylinder 3 and the resin tank 4, and the outlet oil passage 12 and the inlet oil passage 14 are defined respectively in the thicker side walls of the cylinder 3 and the tank 4. The outer shell is therefore of a single-walled structure. As a result, the hydraulic pump assembly 30 for use in a power steering device for an outboard engine is made up of a reduced number of components and has reduced dimensions.

Since the joint pipe 16 is interposed between the inlet oil passage 14 in the tank 4 and the oil passage 15 in the cylinder 3, air is prevented from being trapped into working oil flowing through the oil passages 14, 15 when the tank 4 and the cylinder 3 are deformed because of the different materials thereof.

The resin tank 4 is fastened to the lower end of the metal accumulator cylinder 3, with the oil passage 14 defined in the wall 4*a* of the tank 4 in communication with the oil reservoir 4*b*, and the cylinder 3 has the oil passage 23 communicating with the actuator in the power steering device. Consequently, it is not necessary to install any independent pipes in the hydraulic pump assembly 30, and as a result, the number of parts used in the hydraulic pump assembly 30 is reduced.

The outer dimensions of the hydraulic pump assembly 30 are substantially the same as those of the accumulator cylinder 3. Therefore, the dimensions of the hydraulic pump assembly 30 are held to a minimum.

Since the tank 4 defining the oil reservoir 4*b* to which no high pressure is exerted is made of resin, the weight of the hydraulic pump assembly 30 is reduced.

Although there have been described what are at present considered to be the preferred embodiments of the invention, it will be understood that the invention may be embodied in other specific forms without departing from the essential characteristics thereof. The present embodiment is therefore to be considered in all respects as illustrative, and not restrictive. The scope of the invention is indicated by the appended claims rather than by the foregoing description.

I claim:

1. A hydraulic pump assembly having a pump and an accumulator combined therewith, characterized in that an outer shell of the hydraulic pump assembly is divided into an accumulator cylinder of metal and a tank of resin, and said accumulator cylinder and said tank have thicker side portions, respectively, which define therein an outlet oil passage and an inlet oil passage, respectively.

2. A hydraulic pump assembly according to claim 1, further including a joint pipe interposed between said inlet oil passage in said tank and an oil passage in said accumulator.

3. A hydraulic pump assembly for supplying working oil to an actuator in a power steering device for an outboard engine, comprising:

an accumulator for storing working oil under pressure;

a tank unit for holding working oil therein;

a pump for forcibly supplying working oil from said tank unit to said accumulator;

an electric motor for driving said pump;

said accumulator comprising an accumulator cylinder having an inner bore, a partition fixedly fitted in said accumulator cylinder, a piston slidably fitted in said accumulator cylinder and positioned between a dead end of said accumulator cylinder and a side of said partition, a pressure working oil chamber defined between a side of said piston and said dead end, a pressure gas chamber defined between another side of said piston and said partition, and an outlet oil passage defined in a side wall of said cylinder and connecting said pressure working oil chamber to the actuator in the power steering device;

said pump being disposed in a bottom wall of said accumulator cylinder;

said electric motor being mounted on said bottom wall; and said tank unit comprising a tank attached to the bottom wall of said accumulator cylinder and housing said electric motor therein, an oil reservoir defined in said tank and holding working oil, and a first inlet oil passage defined in a side wall of said tank and connecting said oil reservoir to said pump.

4. A hydraulic pump assembly according to claim 3, wherein said accumulator cylinder is made of metal and said tank is made of resin.

5. A hydraulic pump assembly according to claim 4, wherein said bottom wall of the accumulator cylinder has a second inlet oil passage defined therein and connected to said pump, further including a joint pipe interposed between said first inlet oil passage and said second inlet oil passage.

6. A hydraulic pump assembly according to claim 3, further including a controller disposed in said accumulator cylinder for detecting a pair of spaced limit positions for said piston, said controller comprising means for energizing said electric motor when said piston reaches one of said limit positions in which a minimum amount of working oil is held in said pressure working oil chamber, and for de-energizing said electric motor when said piston reaches the other of said limit positions in which a maximum amount of working oil is held in said pressure working oil chamber.

7. A hydraulic pump assembly according to claim 6, wherein said controller operates independently of the power steering device for the outboard engine.

* * * * *